US007618042B1

(12) United States Patent
Johnson

(10) Patent No.: US 7,618,042 B1
(45) Date of Patent: Nov. 17, 2009

(54) WORD FORMING TILE GAME

(76) Inventor: David A. Johnson, 535 Richey St., #105, Corona, CA (US) 92879

( * ) Notice: Subject to any disclaimer, the term of this patent is extended or adjusted under 35 U.S.C. 154(b) by 248 days.

(21) Appl. No.: 11/738,704

(22) Filed: Apr. 23, 2007

(51) Int. Cl.
*A63F 3/06* (2006.01)

(52) U.S. Cl. ..... 273/272

(58) Field of Classification Search ..... 273/272, 273/299
See application file for complete search history.

(56) References Cited

U.S. PATENT DOCUMENTS

RE24,409 E * 12/1957 Withers ..... 273/240
3,413,004 A * 11/1968 Smith ..... 273/269
3,606,336 A * 9/1971 Krause ..... 273/272
4,601,473 A 7/1986 Dubren et al.
4,690,410 A 9/1987 Berton
4,826,175 A * 5/1989 Quatrino ..... 273/299
4,923,199 A * 5/1990 Hahn ..... 273/299
4,934,711 A * 6/1990 Runstein ..... 273/272
5,230,515 A * 7/1993 Cohen ..... 273/261
5,230,518 A * 7/1993 Crowe et al. ..... 273/459
5,417,432 A * 5/1995 Dwyer ..... 273/299
5,458,338 A * 10/1995 Beardsley ..... 273/269
6,168,439 B1 * 1/2001 Anderson ..... 434/167
6,241,246 B1 * 6/2001 Guttin et al. ..... 273/139
6,378,868 B1 * 4/2002 La Bossiere ..... 273/272
6,422,562 B1 * 7/2002 Daniel ..... 273/272
6,612,578 B2 * 9/2003 Falciglia, Sr. ..... 273/269
7,275,746 B2 * 10/2007 Jensen ..... 273/272

* cited by examiner

*Primary Examiner*—William M Pierce
(74) *Attorney, Agent, or Firm*—Venable LLP; Stefan J. Kirchanski

(57) ABSTRACT

A word forming game with a plurality of chips, each bearing either a letter or a wild card symbol on one surface. Players take successive turns at flipping over chips until a timer indicates the end of play. Whenever a player can form an English word from at least three of the previously flipped over chips, the player says the word and then takes the letters and forms the word. If the previously formed word is owned by a different player, it is taken by the player forming the new word. At any time a player may challenge a word previously formed by another player. A wild card symbol allows the chip to be used as any letter of the alphabet. When the play ends, the score of each player is determined depending on how many words that player own and how many letters each word contains.

16 Claims, 2 Drawing Sheets

WORD FORMING TILE GAME

BACKGROUND OF THE INVENTION

1. Area of the Art

The present invention relates to word games and in particular to an improved word building game featuring lively interactions between players.

2. Description of the Prior Art

Various word games have long enjoyed considerable popularity. Anagrams and various forms of coded or hidden words are fascinating to many people. Even today when many decry the overall quality of general education and the failure of the population to read, crossword puzzles and similar word puzzles continue to enjoy great popularity. However, for the younger person faced with a blizzard of video games, handheld electronic game playing devices and even games on cell phone and personal digital assistants, the typical word game may appear fairly sedate.

The archetypal modern word game is probably Scrabble® where the players randomly draw letters and attempt to add them to a growing crossword structure. This game combines word building skills with a bit of a crossword structure. The players gain points by making words out of the letters they have drawn and appending the new word to the growing crossword. They can also gain points by modifying existing words in the structure. The score is based on the number and type of letter used with certain letters being worth more than others. The value of the letter is related to the difficulty in using the particular letter to form a word. Word Yahtzee is a word game where the letters are chosen by rolling dice which have letters on their faces. After a roll the player has a set amount of time to make words out of the letters rolled. The scoring is somewhat complex being based on as per letter value (as in Scrabble) with a number of other special situations (e.g., all vowels). The time limit per turn adds suspense and shows off the player's skill but there is somewhat a dearth of player interaction.

The general characteristics of word forming games include a means to randomly provide letters for the players to use; a means for displaying the provided letters to form words and a method for assigning scores based on the formed words—the score often being related to the difficulty of the letter. There are a large number of United States Patents for word forming games. Some games such as that disclosed in U.S. Pat. No. 4,601,473 to Dubren et al. which discloses a somewhat complex structure for forming words from letters printed on small disks. The excitement of the game is enhanced by allowing one player to capture words already formed by another player. U.S. Pat. No. 4,690,410 to Berton discloses a word game played with optionally interlocking tiles. The tiles are partitioned among the players who then take turns revealing tiles and forming words. Again, the level of interaction in the game is enhanced by allowing the players to capture words from other players.

SUMMARY OF THE INVENTION

The invention is a word forming game that includes elements of speed, skill and competition. A plurality of chips, each chip bearing an indicium, either a letter of the alphabet or a wild card symbol, on one surface is arranged indicia sides down. Players take successive turns at flipping over chips. When all of the chips have been exposed a timer is started to measure a completion interval and the end of play is indicated by the end of that interval. When a player can form an English word from at least three of the previously flipped over chips, the player says the word and then takes the letters and arranges the word in front of the player indicating that the newly formed word belongs to the player. If one of the players can form a new word by combining a previously formed word with one or more of the flipped over chips, that player says the new word and adds the letters to the previously formed word (possibly rearranging the letters of the previous word). If the previously formed word is owned by a different player, it is taken by the player forming the new word. In forming a new word from a previously formed word it is not permissible to merely add an "s" to an existing word.

At any time a player may challenge a word previously formed by another player if the player doubts that the word is a real word or is spelled correctly and provided the player has at least one previously formed word. To make a challenge the player must have at least one previously formed word of his or her own. If a dictionary or another means of validating the word shows that the word does not exist, the word is returned to the pool of previously flipped chips and the challenging player may take a word of his or her choosing from the owner of the challenged word. If the challenged word is determined to exist, the challenging player must give one of his previously formed words to the owner of the challenged word—the choice of words being up to the challenged player.

If a player turns over a wild card symbol, the chip is taken by the player and may subsequently be used as any letter of the alphabet. However, once the chip has been identified as a particular letter, it remains fixed as that letter for that game. The game end when the timing device indicates the end of the completion interval, which interval can be about two minutes although other intervals can readily be used. When the play ends, the score of each player is determined depending on how many words that player own and how many letters each word contains. The player having the highest score wins the game.

DETAILED DESCRIPTION OF THE INVENTION

Figure 1:
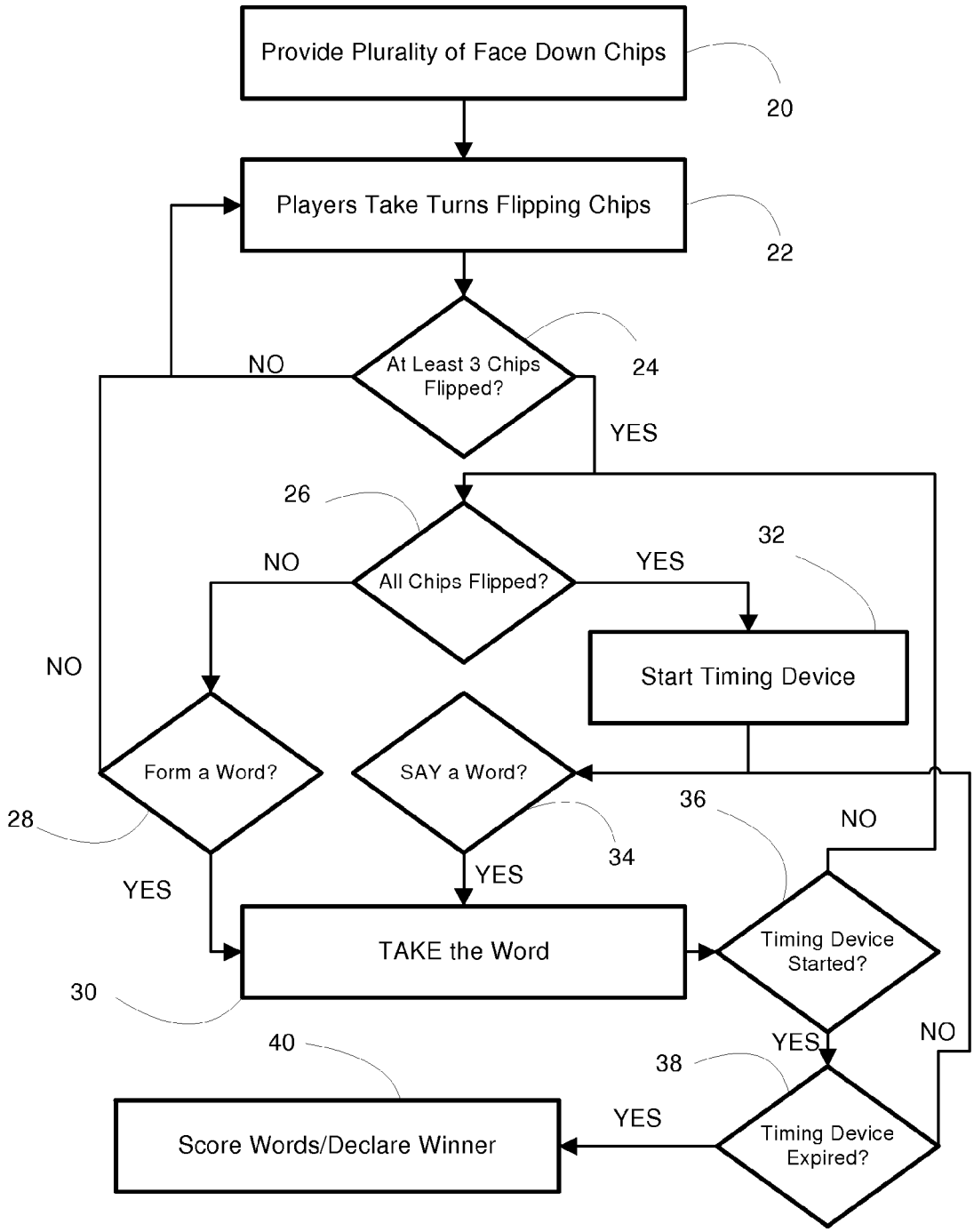
FIG. 1 is a flow chart of the steps of playing one embodiment of the game.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a word forming game with player interaction and simple scoring.

GAME COMPONENTS: The game is based on chips or tiles that have indicia on one surface and are blank or marked with a common design on the opposite surface. The exact number of chips can vary somewhat, but experimentation has shown that for between two and six players the optimal number of chips is around 126. Most of the chips have indicia that are letters of the Roman alphabet. A limited number of chips are marked with a special "wild card" symbol. While not wishing to be limited to this precise layout, the inventor has discovered that a breakdown of ten "A" chips, three "B" chips, three "C" chips, five "D" chips, thirteen "E" chips, three "F" chips, four "G" chips, three "H" chips, ten "I" chips, two "J" chips, two "K" chips, five "L" chips, three "M" chips, seven "N" ships, nine "O" chips, three "P" chips, two "Q"

chips, seven "R" chips, five "S" chips, seven "T" chips, five "U" chips, three "V" chips, three "W" chips, two "X" chips, two "X" chips, two "Z" chips and three "wild card" chips is an effective mix for a lively game and represents one "package" of 126 chips.

The selection of chip distribution is not random in that the chips frequency distribution is selected to maximize the number of words that can be readily constructed. The choice of letter distribution has been perfected by considerable trial although alternative distributions may also give the desired result. Table 1 shows the chips sorted in order of frequency with the most common chip "E" first. Table 2 shows the ranking of letter use in the English language as a whole. As might be expected the chip frequency empirically selected to result in ease of word production shows a relationship to Table 2. In the first half of Table 1 all of the letters with the exception of "B" and "G" (marked with asterisks) are also found in the first half of Table 2. The letter distribution in Table 1 favors vowels slightly more than English letter frequency might predict because people find it easier to make words if they have a sufficiency of vowels.

TABLE 1

| | |
|---|---|
| E | 1 |
| A | 2 |
| I | 3 |
| O | 4 |
| N | 5 |
| R | 6 |
| T | 7 |
| D | 8 |
| L | 9 |
| S | 10 |
| U | 11 |
| G* | 12 |
| B* | 13 |
| C | 14 |
| F | 15 |
| H | 16 |
| M | 17 |
| P | 18 |
| V | 19 |
| W | 20 |
| Y | 21 |
| J | 22 |
| K | 23 |
| Q | 24 |
| X | 25 |
| Z | 26 |

TABLE 2

| | |
|---|---|
| E | 1 |
| T | 2 |
| A | 3 |
| O | 4 |
| I | 5 |
| N | 6 |
| S | 7 |
| R | 8 |
| H | 9 |
| L | 10 |
| D | 11 |
| C | 12 |
| U | 13 |
| M | 14 |
| F | 15 |
| P | 16 |
| G | 17 |
| W | 18 |
| Y | 19 |
| B | 20 |
| V | 21 |

TABLE 2-continued

| | |
|---|---|
| K | 22 |
| X | 23 |
| J | 24 |
| Q | 25 |
| Z | 26 |

In addition to the letter chips, the game also requires a timing device, a score recording device and a word validating device. Any simple timing device that can accurately time short intervals is usable. One possible timing device is an hour glass type egg timer. Simple electronic timers are ideal. As will be explained below, the score is based on the number of words a player amasses. To this end a very simple recording device such as a paper writing surface will work. Obviously, more complex score recorders such as electronic touch tablets or specialized electronic calculators may also be used. A good quality dictionary is an adequate word validating device. In an embodiment using an electronic scoring device (which can advantageously incorporate the timing device) an electronic dictionary can easily be included.

GAME PLAY: The steps of playing the game are shown diagrammatically in FIGS. 1 and 2. In step 20 the chips are placed letter-side down on the playing surface making sure all the chips are scrambled to destroy any order. In step 22 the players take turns flipping over the chips. Generally, play moves in a clockwise or counterclockwise direction (as is decided in advance) although other ordering of turns is also possible. This continues until the last of the tiles is flipped over (step 26) at which juncture the timing device is started (step 32) to time the completion interval. During that interval word making, etc. continues until the timer indicates that the interval and the game are completed. While two minutes is a useable time period for the completion interval, it can be beneficial to be able to use a variety of time intervals. This way game play can start with a relatively long completion interval and get shorter and more exciting with successive plays as the players get better at the game. If a simple fixed timing device is used (e.g., a two minute hour glass), multiple periods (e.g., two turns of the device) can also be used. With a more flexible timing device, virtually any time interval can be selected.

When a player takes a turn at playing he or she should turn a randomly selected chip over (step 22) in a manner that allows all the players to simultaneously view the revealed letter. One method is for a player to place an index finger and thumb on the chip and flip the chip by pulling the index finger towards the player. This allows every player an equal view of the newly revealed letter. That is, by flipping the letter towards the player, the letter will be revealed to all.

Figure 2:
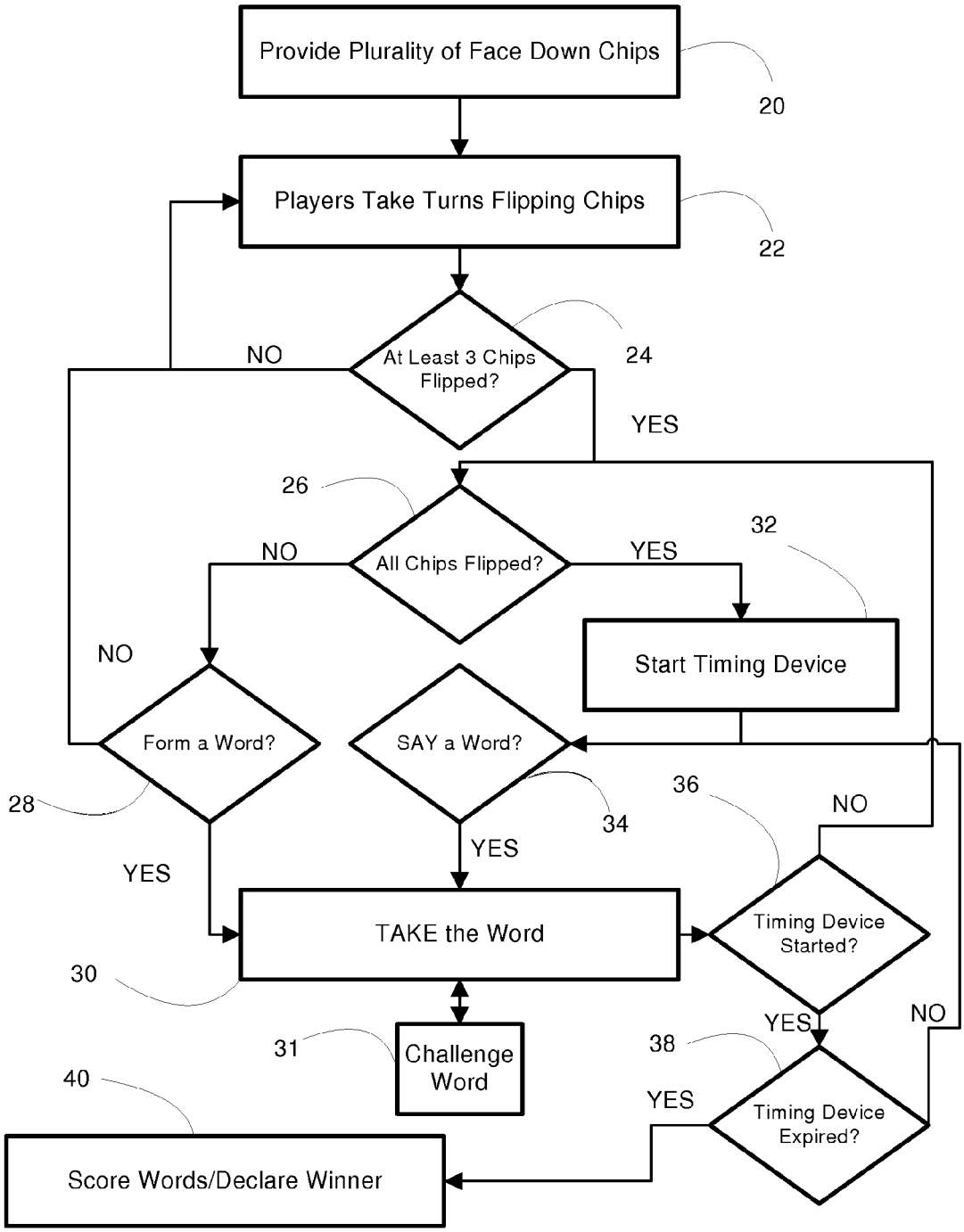
FIG. 2 is flow chart of the steps of playing a second embodiment of the game.

The game is based on speed and quick thinking. As the chips are being turned a word can be formed with a minimum of three letters. This means that at the start of a game at least three successive players must turn over chips before the first word can be formed. This is tested in step 24. When a player realizes that some or all of the revealed letters can be used to form a word (steps 28 and 34), the player must SAY (step 30) the word aloud first and then TAKE the formed word (take the tiles forming the word) and place it in front of himself. Prefixes and suffixes are allowed as well as compound words. Abbreviations, hyphenated words, and proper nouns are not allowed. When a word is first formed, a simple plural that is a merely terminal "s" is allowed. On a subsequent turn a player can add new letters to create a new word, but a word that has already been formed cannot be pluralized with only an added "s" to create a new word. When a player TAKES a word and places it in front of himself, as soon as the player takes his hand away from the word, the word is open to challenge (FIG. 2, step 31). Each time a player TAKES a word, it is determined if the Timing Device has been started (step 36).

The object is to end the game holding the highest scoring words. A player can increase his score by forming new words, by adding letters to words he already owns (thereby increasing the score of the words) or by taking possession of a STOLEN word. A word can be STOLEN when a player during his or her turn is able to add one or more letters from the pool to a word owned by another player. The adding player can then SAY the new word and TAKE it away from the original owner and place it with his or her own words. When taking a STOLEN word, all of the letters of the previously formed word must be used along with the newly added letter(s). The letter "s" can be used as a plural, only when the player changes the word from the previous word. An example is found in the word "top". When an "s" is added, it can become "stop", "pots", "post", or "opts", it can not become "tops" because this is a simple plural of "top," the original word.

SCORING: When the completion interval is ended (that is, the Timing Device expires as tested at step 38), the words of each player are scored and a winner is declared (step 40). The player with the most points at the end of the playing period is the winner. Points are awarded according to the words the player holds at the end of play. Words that are three, four or five letters long are worth one point; words of six letters are worth two points. Words of seven letters are worth three points; words of eight letters are worth four points, and words of nine letters are worth five points. Words that are ten or more letters in length are worth six points.

ADDITIONAL RULES: When a word is STOLEN, all the letters original letters plus added letters must be used. The player, who forms or steals a word following these rules, becomes the owner of the word. That person must then form and SAY the word so everyone can see the word. As soon as the word is released (no longer touched by the player), it is open to challenge. The overall strategy is stealing the other person's words and preserving one's own words. The player that can successfully achieve this has good chance of winning the game. The player with the most points (based on word number and length) at the end of the time period is the winner.

The wild card chips add an additional dimension to the game. Each of these chips becomes ONE letter of the turner's choice. He or she has the option to use this letter at anytime before the expiration of the game. That is, the person who reveals a wild card chip may keep the chip and use it at any time. In a first embodiment the person who reveals a wild card chip must immediately declare to the whole group which letter he or she has decided the wild card chip to represent so that all the players will be informed. In an alternative embodiment, the identity of the wild card chip is not declared until the chip is used to form a word. In either embodiment once the identity is declared it becomes fixed and its identity does not change even if another player steals the word containing the wild card chip.

The CHALLENGE allows one player challenges the existence of a word. Existence means that the word exists in the dictionary. Obviously, if a word is misspelled, it does not exist. The challenging player must have at least ONE other word (i.e., one besides the challenged word) for collateral. A player may TAKE a word at any time and may similarly issue a CHALLENGE at any time. The only restriction is that when a player has STOLEN a word or issued a CHALLENGE, that player cannot take another STOLEN word or issue another CHALLENGE until either a tile has been flipped or another player has taken a STOLEN word or issued a CHALLENGE. When a player challenges another player he must say, "I challenge you", at this time the other player must either accept the challenge or reject it. If the player does not accept the challenge the letters of the challenged word go back to the pool of revealed letters. If the player accepts the challenge, the challenger along with the player being challenged look up the word in the dictionary (or otherwise use the available word validating device). At this time, play is suspended (and if this happens in the completion interval, the timer is stopped) until the challenge is completed. If the word is in the dictionary the challenger must forfeit one word to the challenged player according to the challenged player's choice. If the word it is not in the dictionary the challenged player forfeits one word according to the choice of the challenger provided the challenged player has any words, and the word in dispute then goes back to the revealed letter pool. It stands to reason that one or more players may refrain from challenging a word because of the risk of losing a word. Generally, a player having the largest number of words will be more willing to make a challenge because he or she has proportionally less to lose. The player with the most words usually holds the upper hand in disputes.

A foreign word is only allowed if it is regularly used in the English language and is thus found in the dictionary. It is recommended that the dictionary used be an up to date one, because new words are always being added to the English language. The goal of this game is to improve vocabulary and spelling skills. This game is not intended to create vulgar or derogatory words.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. A word forming game comprising the steps of:

providing a plurality of chips having indicia on one surface, the chips being placed indicia surface down, a timing device and a word validating device wherein at least a majority of the indicia are letters of the alphabet;

allowing the players to take turns in order, wherein a turn comprises turning over one chip from the plurality to reveal the chip's indicium wherein the chip is added to a pool of revealed indicia;

forming an English word, wherein the step of forming includes the steps of:

a player attempting to form an English word from at least three of the revealed indicia in the pool or from at least one of the revealed indicia in the pool and all of the indicia of a word previously formed; and the player placing the English word thus formed into a display of words owned by the player;

starting the timing device to time a timing period as soon as all of the chips have been turned over and repeating the step of forming;

ending play when the end of the timing period is indicated by the timing device;

creating a score for each player wherein the score is determined by a number and a length of words in the player's display; and declaring a winner, the winner being the player having the highest score.

2. The word forming game according to claim 1, wherein a minority of the indicia are wild card indicia that the player turning over a chip having a wild card indicium may use the chip as any letter of the alphabet.

3. The word forming game according to claim 1, wherein the timing device is selected from the group consisting of an hour glass, a digital timer and a mechanical timer.

4. The word forming game according to claim 1, wherein the timing period ranges from about one minute to about five minutes.

5. The word forming game according to claim 1, wherein the step of attempting to form an English word from all of the indicia of a word previously formed does not allow the English word to be a simple plural of the word previously formed.

6. The word forming game according to claim 1 further comprising the step of challenging the existence of a word previously formed by a different player.

7. The word forming game according to claim 6, wherein the step of challenging the existence of a word comprises using a determination made by the word validating device.

8. The word forming game according to claim 7, wherein a word determined not to exist is returned to the pool of revealed indicia.

9. The word forming game according to claim 7, wherein the step of challenging further comprises a forfeit of a word from the display of words formed by one of the players, the player selected according to the determination of the word validating device.

10. A word forming game comprising the steps of:

providing a plurality of chips having indicia on one surface, the chips being placed indicia surface down, a timing device and a dictionary wherein at least a majority of the indicia are letters of the alphabet;

allowing the players to take turns in order, wherein a turn comprises turning over one chip from the plurality to reveal the chip's indicium wherein the chip is added to a pool of revealed indicia;

forming an English word, wherein the step of forming includes the steps of:

a player attempting to form an English word from at least three of the revealed indicia in the pool or from at least one of the revealed indicia in the pool and all of the indicia of a word previously formed; and the player placing the English word thus formed into a display of words owned by the player;

challenging the existence of a word previously formed by a different player by verifying existence of the word in the dictionary;

starting the timing device to time a timing period as soon as all of the chips have been turned over and continuing repeating the steps of forming and challenging;

ending play when the end of the timing period is indicated by the timing device;

creating a score for each player wherein the score is determined by a number and a length of words in the player's display; and declaring a winner, the winner being the player having the highest score.

11. The word forming game according to claim 10, wherein a minority of the indicia are wild card indicia that the player turning over a chip having a wild card indicium may use the chip as any letter of the alphabet.

12. The word forming game according to claim 10, wherein the timing device is selected from the group consisting of an hour glass, a digital timer and a mechanical timer.

13. The word forming game according to claim 10, wherein the timing period ranges from about one minute to about five minutes.

14. The word forming game according to claim 10, wherein the step of attempting to form an English word from all of the indicia of a word previously formed does not allow the English word to be a simple plural of the word previously formed.

15. The word forming game according to claim 10, wherein a word determined in the challenging step not to exist is returned to the pool of revealed indicia.

16. The word forming game according to claim 7, wherein the step of challenging further comprises a forfeit of a word from the display of words formed by one of the players, the player selected according to the determination of the word validating device.

* * * * *